United States Patent [19]

Burnham et al.

[11] Patent Number: 4,524,318

[45] Date of Patent: Jun. 18, 1985

[54] BAND GAP VOLTAGE REFERENCE CIRCUIT

[75] Inventors: Stephen R. Burnham; Paul M. Henry, both of Tucson, Ariz.

[73] Assignee: Burr-Brown Corporation, Tucson, Ariz.

[21] Appl. No.: 614,337

[22] Filed: May 25, 1984

[51] Int. Cl.[3] ..... G05F 3/20

[52] U.S. Cl. ..... 323/313; 330/257

[58] Field of Search ..... 323/313, 314, 315, 316; 330/257, 288, 297

[56] References Cited

U.S. PATENT DOCUMENTS

| | | | |
|---|---|---|---|
| 3,887,863 | 6/1975 | Brokaw | 323/314 |
| 4,399,399 | 8/1983 | Joseph | 323/315 |
| 4,443,753 | 4/1984 | McGlinchey | 323/313 |
| 4,492,914 | 1/1985 | Hitomi | 323/313 |

*Primary Examiner*—Peter S. Wong
*Assistant Examiner*—Judson H. Jones
*Attorney, Agent, or Firm*—Cahill, Sutton & Thomas

[57] ABSTRACT

A band gap voltage reference circuit includes first and second NPN transistors coupled as differential pair having ratioed emitters, to produce an offset voltage, and third and fourth emitter-coupled PNP transistors connected as a current mirror to function as load devices for the first and second transistors. The emitters of the third and fourth transistors are coupled to a current source and also to a fifth PNP emitter follower transistor which drives the base of a sixth emitter follower transistor connected to the collector of a seventh transistor, the emitter of which is connected to a series string including first and second resistors. The emitter of the seventh transistor is coupled to the base of the first transistor and the junction between the first and second resistors is coupled to the base of the second transistor. The emitter of the sixth transistor is coupled to series connected third and fourth resistors, the junction of which is coupled to the base of the seventh transistor. The ratio of the first and second resistors is adjusted to cause a band gap voltage produced on the base of the seventh transistor to have a very low temperature coefficient. The third and fourth resistors are ratioed to produce an output voltage at the emitter of the sixth transistor which is scaled up from the band gap voltage.

16 Claims, 3 Drawing Figures

BAND GAP VOLTAGE REFERENCE CIRCUIT

BACKGROUND OF THE INVENTION

The invention relates to voltage regulator circuits of the kind commonly called band gap voltage references, and more particularly to improved band gap voltage reference circuits which have high open loop gain, low sensitivity to variations in load current, and are adjustable to scaled-up amplitudes.

The known band gap voltage reference circuits have various shortcomings. Most of them are quite complex, when implemented in integrated circuits, and occupy a large amount of semiconductor die area. Some of the prior band gap voltage reference circuits do not have adequate voltage gain and are unduly sensitive to variations in "load current" which must be supplied to a load circuit by the band gap voltage reference circuit. Some of the prior band gap voltage reference circuits are capable of generating only a particular reference voltage, and cannot be adjusted to produce a higher scaled-up temperature-independent reference voltage.

The closest prior art known to applicants is a band gap voltage reference circuit developed by co-inventor Henry, which utilizes the same "gain cell" or "band gap cell" as the present invention, and provides positive feedback from the output of the circuit to the gain cell. The positive feedback includes an NPN emitter follower output transistor, and an NPN transistor having its emitter connected to the base of the emitter follower output transistor, its collector connected to a current mirror which provides the bias current of the gain cell, and its base connected to the emitters of the PNP transistors that constitute the load devices of the NPN transistors that constitute a differential input pair of the band gap cell. The emitter follower output transistor causes the input offset voltage of the NPN differential input transistor pair of the band gap cell to be developed across a first resistor. A second resistor is connected in series with the first resistor, and the ratio of the first and second resistors is adjusted so that the positive temperature coefficient of the voltage developed across the first resistor offsets the negative temperature coefficient of a diode connected in series with them. The impedance seen at the emitter of the NPN output transistor of this band gap reference voltage circuit is very low, being essentially equal to the sum of the first and second resistors. The bias current of the band gap cell is established by a current which is temperature dependent. This leads to variations with temperature in the input offset voltage of the gain cell, and hence, in the reference voltage produced by this band gap voltage reference circuit. The low input impedance prevents effective scaling up of the band gap voltage produced by this circuit.

In short, there remains a need for an improved band gap reference voltage circuit which is not unduly complex, which can be easily implemented with conventional integrated circuit processing, which has high output impedance, high gain, and has a temperature independent output voltage that is scaled up from the band gap voltage generated from the input offset voltage of the differential pair of the band gap cell, and which is much more independent of variations in load current than previous band gap voltage reference circuits.

SUMMARY OF THE INVENTION

Accordingly, it is an object of the invention to provide an improved band gap voltage reference circuit which has higher gain than prior art band gap voltage reference circuits.

It is another object of the invention to provide an improved band gap voltage reference circuit that avoids errors due to load current changes.

It is another object of the invention to provide an improved band gap voltage reference circuit that produces a reference voltage having a very low temperature coefficient that can be adjusted to any of a continuum of scaled up output voltages.

It is another object of the invention to provide an improved band gap voltage reference circuit that is more independent of power supply variations than prior band gap voltgage reference circuits.

It is another object of the invention to provide an improved band gap voltage reference circuit having the foregoing advantages without greatly increasing its complexity over that of prior band gap voltage reference circuits.

It is another object of the invention to provide an improved band gap voltage reference circuit that can produce temperature independent, scaled up reference voltage levels in a wide range between the high and low power supply conductor voltages that power the circuit.

Briefly described, and in accordance with one embodiment thereof, the invention provides an improved band gap voltage reference circuit including a band gap cell having a pair of differential input terminals across which a differential input offset voltage is applied; an incremental error in a differential input offset voltage is amplified by the gain of the band gap cell. The resulting output of the band gap cell is applied to emitter follower circuitry to produce correction of the applied differential input offset voltage by conducting a feedback current through first and second resistors that are external to the band gap cell, the ratio of which resistors is adjusted to produce a predetermined temperature coefficient of a band gap voltage generated by the band gap cell. The output of the band gap cell is connected to bootstrap circuitry that results in an extremely high output impedance of the band gap cell, assuring that the gain of the band gap cell is very high. An incremental output signal produced by the band gap cell is input to unity gain follower or buffer circuitry to provide the feedback current through the first and second resistors, and also to produce another feedback current through a third resistor across which the band gap voltage is developed and through a fourth resistor by means of which the band gap voltage is scaled up to a higher value determined by the ratio of the third and fourth resistors. In the described embodiment of the invention, the band gap cell includes first and second NPN transistors and first and second PNP transistors. The emitters of the first and second NPN transistors are connected together, and the emitters of the first and second PNP transistors, which function as load devices for the first and second NPN transistors, respectively, are also connected together. The bases of the first and second PNP transistors are connected together and are also connected to the collector of the second PNP transistor. An NPN current mirror circuit includes two NPN current source transistors. The collector of the first NPN current source transistor is connected to the common emitters of the first and second NPN transistors of the band gap cell. The collector of the second NPN current source transistor is connected to the collector of a third PNP transistor that has its emitter connected to the emitters of the first and second PNP transistors and has its base connected to the collector of the first NPN transistor of the band gap cell. A first resistor is coupled between the bases of the first and second NPN transistors of the band gap cell and is also connected in series with a second resistor and with a diode connected NPN transistor that controls the NPN current mirror circuit. The emitters of the first, second, and third PNP transistors are connected to the base of a fourth PNP transistor, the collector of which is connected to ground and the emitter of which is connected to the base of a third NPN transistor. The third NPN transistor is connected as an emitter follower, having third and fourth series-connected resistors connected between ground and the emitter of the third NPN transistor. The junction between the third and fourth resistors is connected to the base of a fourth NPN transistor. The fourth PNP transistor, and the third and fourth NPN transistors are included in a feedback circuit that causes a voltage equal to the differential offset of the first and second NPN transistors of the band gap cell to be developed across the first resistor when the band gap voltage reference circuit operates. Current is supplied to the band gap cell and also to the emitter of the third PNP transistor through a diode-connected PNP transistor that functions as the control device for a PNP current mirror circuit, a first PNP current source transistor of which is connected to the emitter of the fourth PNP transistor, the base of the third NPN transistor, and collector of the fourth NPN transistor. A second PNP current source transistor of the PNP current mirror circuit supplies a fifth NPN transistor, the emitter of which is connected to the second NPN transistor of the first NPN current mirror circuit. The collector of the fifth NPN transistor controls the base of a PNP transistor connected in series with the diode connected PNP transistor to control the flow of current supplying the band gap cell and the third PNP transistor. In operation, the ratio of the first and second resistors controls the temperature coefficient of a band gap voltage produced at the base of the fourth NPN transistor, and the ratio between the third and fourth resistors scales the band gap voltage up to a predetermined level. Load current variations are divided by the beta of the third NPN transistor and also are divided by the beta of the fourth PNP transistor, and in effect are absorbed by the third PNP transistor, and therefore, have essentially no effect on the differential offset voltage of the diferential input pair constituting the first and second NPN transistors of the band gap cell. The open collector impedance of the fourth NPN transistor assures a very high open loop gain that in turn ensures a temperature independent output voltage having the desired scaled up value being produced at the emitter of the third NPN transistor.

DESCRIPTION OF THE INVENTION

Figure 1:
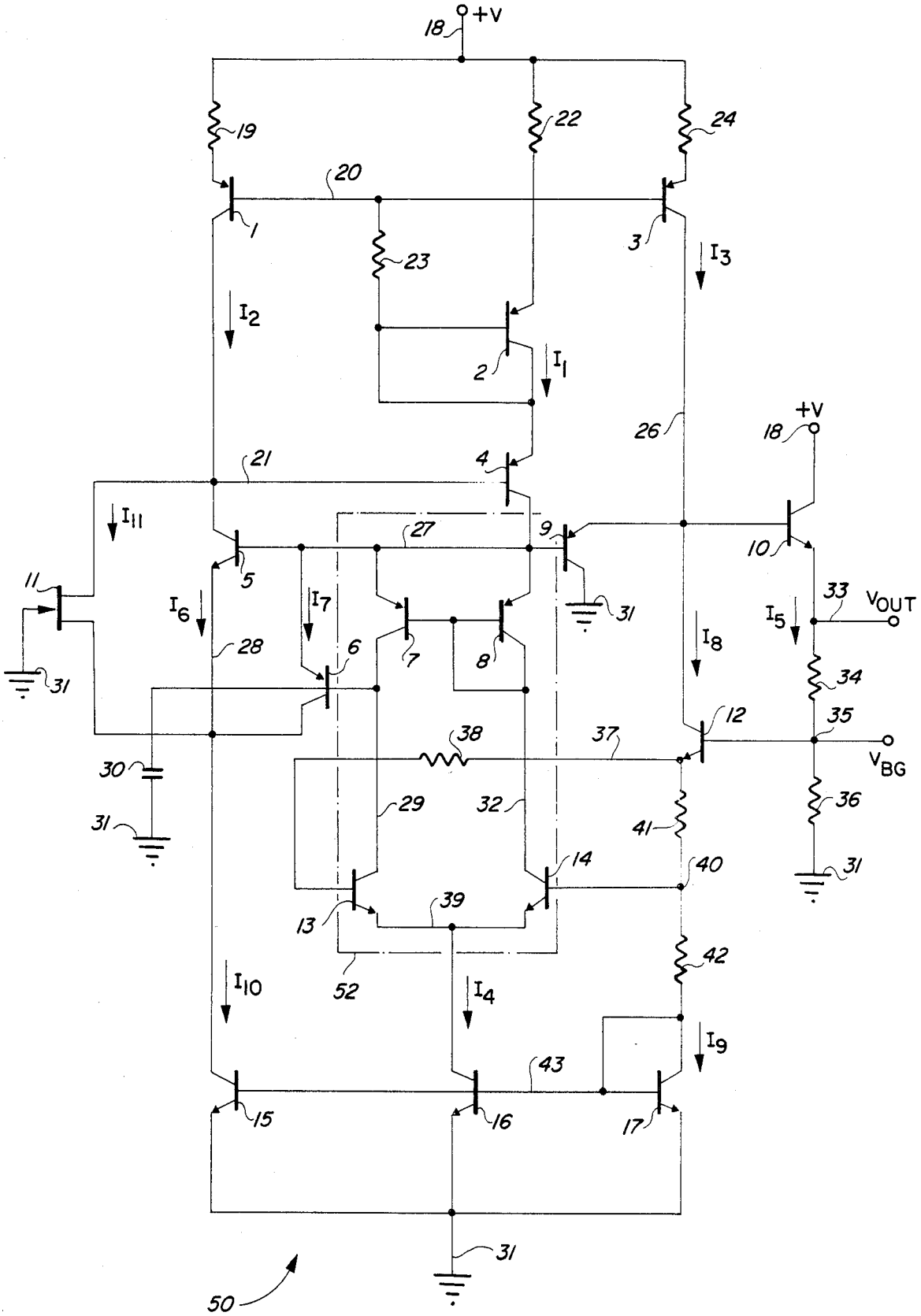
FIG. 1 is a detailed circuit schematic diagram of one embodiment of the present invention.

Referring now to FIG. 1, band gap voltage reference circuit 50 includes a lateral PNP transistor 1 having its emitter connected by means of resistor 19 to positive supply voltage conductor 18. The base of PNP transistor 1 is connected to conductor 20, and its collector is connected to conductor 21. A second lateral PNP transistor 2 has its emitter connected by resistor 22 to positive supply voltage conductor 18 and has its base connected by resistor 23 to conductor 20. The collector of PNP transistor 2 is connected to its base. A third lateral PNP transistor 3 has its emitter connected by resistor 24 to positive supply conductor 18. The base of transistor 3 is connected to conductor 20, and its collector is connected to conductor 26.

The collector and base of transistor 2 are connected to the emitter of lateral PNP transistor 4, the base of which is connected to conductor 21. The collector of PNP transistor 4 is connected to conductor 27. NPN transistor 5 has its collector connected to conductor 21 and its base connected to conductor 27. The emitter of transistor 5 is connected to conductor 28. PNP transistor 6 has its emitter connected to conductor 27 and its collector connected to conductor 28. The base of PNP transistor 6 is connected to conductor 29.

Transistor 7 is a lateral PNP transistor having its emitter connected to conductor 27 and its collector connected to conductor 29. A ten picofarad capacitor 30 is connected between conductor 29 and ground conductor 31. The base of transistor 7 is connected to the base of another lateral PNP transistor 8, which has its emitter connected to conductor 27. The collector of PNP transistor 8 is connected to its base, and is also connected to conductor 32.

PNP transistor 9 has its base connected to conductor 27 and its emitter connected to conductor 26. The collector of PNP transistor 9 is connected to ground conductor 31. NPN transistor 10 has its base connected to conductor 26, its collector connected to positive supply voltage conductor 18, and its emitter connected to output conductor 33. Conductor 33 is also connected to one terminal of resistor 34, the other terminal of which is connected to conductor 35. Conductor 35 is connected to the base of NPN transistor 12 and is also connected by resistor 36 to ground conductor 31. A substantially temperature-independent band gap voltage $V_{BG}$ appears on conductor 35, and a scaled up, substantially temperature-independent output voltage $V_{OUT}$ appears on conductor 33.

An N channel junction field effect transistor 11 has its gate electrode connected to ground conductor 31. Its source terminal is connected to conductor 28, and its drain electrode is connected to conductor 21.

NPN Transistor 12 has its collector connected to conductor 26 and its emitter connected to conductor 37. Conductor 37 is connected by means of resistor 38 to the base of NPN transistor 13.

The collector of NPN transistor 13 is connected to conductor 29, and its emitter is connected to conductor 39. NPN transistor 14 has its collector connected to conductor 32, its emitter connected to conductor 39 and its base connected to conductor 40. NPN transistors 13 and 14 constitute a differential input pair of a band gap cell 52 enclosed by dotted line 52.

Resistor 41 is connected between conductors 37 and 40. Resistor 42 is connected between conductor 40 and conductor 43, which is connected to both the base and collector of NPN transistor 17. The emitter of NPN transistor 17 is connected to ground conductor 31. NPN transistor 16 has its collector connected to conductor 39, and its base connected to conductor 43. The emitter of NPN transistor 16 is connected to ground conductor 31. NPN transistor 15 has its collector connected to conductor 28, its base connected to conductor 43 and its emitter connected to ground conductor 31.

Table 1 gives exemplary values of the resistors in band gap voltage circuit 50 of FIG. 1. Capacitor 30 has a capacitance of 10 picofarads.

The emitter of transistor 14 is scaled to have ten times the area of the emitter of transistor 13, in this embodiment of this invention, although this ratio can have practical values ranging from roughly 4 to 20. The emitter of transistor 17 has twice the area of the emitter of transistor 16, and the emitter of transistor 15 has three times the emitter area of transistor 16. The emitter area of transistor 3 is twice the emitter area of transistors 1 and 2, although there is nothing critical about this ratio. The emitter areas of transistors 12 and 17 are twice the emitter area of transistor 16, although the emitter area of transistor 12 is not at all critical. The reason for the above indicated emitter area ratios will become apparent as the operation of the band gap voltage reference circuit 50 is described.

TABLE 1

| RESISTOR | OHMS |
|---|---|
| 19 | 3,000 |
| 22 | 3,000 |
| 23 | 200 |
| 24 | 1,500 |
| 34 | 25,167 |
| 36 | 24,784 |
| 38 | 1,183 |
| 41 | 1,183 |
| 42 | 23,655 |

In operation, N-channel junction field effect transistor 11, with its gate electrode connected to ground conductor 31, is biased on so that when power is first applied to +V supply conductor 18, the drain of JFET 11, which is connected to conductor 21, is resistively coupled to +V, thereby causing the emitter-base junction of PNP transistor 4 to be forward biased as its emitter voltage is raised by virtue of current flowing through resistor 22 and diode connected PNP transistor 2. By the time supply conductor 18 reaches approximately 2 diode drops above ground, the current through PNP transistor 2 is mirrored. This initial value of I1 is "mirrored" by PNP current source transistor 1 to produce an initial value of current I2, and the initial value of I1 is also mirrored by PNP transistor 3 to produce an initial value of I3. The collector current of transistor 4, i e., I1 also begins to charge conductor 27 up.

The current I3 begins to charge up conductor 26, turning on NPN emitter follower transistor 10. The current I5 flowing through the emitter of NPN transistor 10 flows through resistors 34 and 35 to ground conductor 31, thereby biasing NPN transistor 12 on. This causes a current I9 to flow through resistors R1 and R2 and NPN diode-connected transistor 17.

Note that NPN transistor 16 is one of the two current source transistors of a current mirror circuit including NPN transistors 15, 16 and 17, so the current I9 is mirrored to produce currents I4 and I10.

Meanwhile, the current I2 charges up conductor 21 and part of I2 flows into the drain of junction field effect transistor 11, producing the current I11. Approximately half of I1 supplies the current I4 produced by NPN current source transistor 16 by flowing through band gap cell 52. Equal amounts of the current flowing through band gap cell 52 through the path including PNP transistors 7 and 13 and the path including transistors 8 and 14. Eventually, as the various currents approach their equilibrium value, conductor 26 is charged up enough by $I_3$ to forward bias PNP transistor 9. The equilibrium values of the above currents for the component values indicated in Table 1 are given below in Table 2.

TABLE 2

| Current | Microamperes |
|---|---|
| I1 | 50 |
| I2 | 50 |
| I3 | 100 |
| I4 | 25 |
| I5 | 100 |
| I6 | 20 |
| I7 | 25 |
| I8 | 50 |
| I9 | 50 |
| I10 | 75 |
| I11 | 30 |

The magnitude of the current I9 (i.e., 50 microamperes) is determined by the offset voltage between the base electrodes of NPN band gap cell transistors 13 and 14, which occurs as a result of equal currents being forced to flow through the emitter of NPN transistor 13 and the emitter of NPN transistor 14, the latter having an emitter area ten times as great as the former.

As indicated in TABLE 2, above, only 25 microamperes of the 50 microampere current I1 flows through the band gap cell 52. The remaining 25$\mu$ amperes flows through PNP transistor 6 as $I_7$. NPN transistor 5 clamps the collector-base voltage of PNP transistor 6 close to zero volts, so it matches the collector-base voltage of PNP transistors 7 and 8, independently of Vout. This clamping action effectively causes the voltage on the collector of PNP transistor 6 to "follow" the emitter voltage of PNP transistor 6, thereby "double bootstrapping" the incremental voltage signal on conductor 29 up to conductor 27.

The temperature coefficient of the emitter-base forward bias voltage of NPN transistor 12 is negative, as is the temperature coefficient of NPN diode connected transistor 17. The ratio of resistors 41 and 42 is adjusted so as to cause the bandgap voltage $V_{BG}$ on conductor 35 to have an essentially zero temperature coefficient. This is accomplished by using the ratio of resistor 42 to resistor 41 to "multiply" the positive temperature coefficient of the term kT/q1n(10) such that it matches the negative temperature coefficient of 2 $V_{BE}$ (of transistors 12 and 17). The series combination of these two terms results in $V_{BG}$ having a zero temperature coefficient.

The current I9 is given by the expression I9 is equal to (kT/q1n(10))/R1, where 10 is the ratio between the emitter areas of NPN transistors 13 and 14.

The constant voltage $V_{BG}$ developed across resistor 36 causes a constant current $V_{BG}/R_{36}$ to flow in resistor 36. This is the value of I5. It can be readily shown that $V_{OUT}$ is given by the expression $$V_{out} = V_{BG}(1 + R_{34}/R_{36})$$

Thus, the value of $V_{OUT}$ can be "scaled up" from $V_{BG}$ to any desired value, within the constraints of the selected power supply voltage applied to conductor 18, and that $V_{OUT}$ will be independent of temperature, since the ratio of resistors 34 and 36 is temperature independent.

Note that since PNP transistor 9 and NPN transistor 10 are both emitter followers, the ratio of resistors 34 and 36 determines the values of the DC voltages on conductors 26 and 27.

The band gap cell 52, in conjunction with the operation of lateral PNP transistor 6, causes PNP transistor 9 to apply whatever voltage is needed to the base of NPN transistor 10 to make the current I8 have the necessary level to develop the required offset voltage across resistor 41.

The resistor 38 connected between the base of NPN transistor 13 and emitter of NPN transistor 12 has a value equal to the value of resistor 41, for the purpose of equalizing the effect of the base current of transistor 14 flowing through resistor 41 and the equal base current of transistor 13, which flows through resistor 38.

The high loop gain of band gap cell 52, in conjunction with the provision of PNP emitter follower transistor 9, and the provision of the high collector impedance of NPN transistor 12, results in very high loop gain for the circuit shown in FIG. 1. This high loop gain assures stable circuit operation, even for low values of compensation capacitor 30, and also assures adequate output current drive capability to assure the accurate scaling up of the voltage $V_{OUT}$ from the bandgap voltage $V_{BG}$. The described structure produces the relatively high "input" impedance at conductor 35, since the impedance of resistors 41, 42 and diode 17 seen by the emitter of NPN transistor 12 in effect is multiplied by the beta of transistor 12.

To understand how the above mentioned high gain is achieved for band gap cell 52, it is helpful to first realize that the gain will be equal to the transconductance $g_m$ of the active device (i.e., NPN transistor 13) times the effective load impedance seen at node 29; those skilled in the art will readily recognize this relationship. It will also be helpful to note that PNP transistors 6, 7 and 8 and NPN transistor 5 are always on. Therefore, conductors 28, 29 and 32 are all at one $V_{BE}$ drop below conductor 27.

Next, assume that there is an incremental decrease in the $V_{BE}$ of transistor 13. This will result in an amplified increase in the voltage on conductor 29. But conductor 29 must remain one $V_{BE}$ drop below the voltage of conductor 27, as must conductors 28 and 32. Therefore, the voltage of conductor 29 rises, as must the voltage of conductors 28 and 32. Since all of the electrodes of each device (i.e., PNP transistors 6 and 7) connected to conductor 29, are effectively functioning as loads with respect to NPN transistor 13, and since they undergo the same voltage transition as conductor 29, these devices represent an almost infinite load impedance to the collector of NPN transistor 13. This technique is referred to as bootstrapping the voltages on conductors 28 and 32 from the voltage on conductor 29. Hence, the gain of band gap cell 52 is very high, as desired.

Variations in load current caused by an output load (not shown) connected to conductor 33 are divided by the beta of NPN transistor 10 and also by the beta of PNP transistor 9. These "attenuated" load current variations then are effectively "absorbed" by PNP transistor 6. NPN transistor 5 therefore does not "see" the effect of such load current variations, so these effects are not transmitted back via PNP transistor 4 to the emitters of PNP transistors 7 and 8 of band gap cell 52.

Ten picofarad capacitor 30 stabilizes the operation of the band gap voltage reference circuit 50. (It is noteworthy that a much larger 100 picofarad stabilizing capacitor is required for the circuit disclosed in the above-mentioned U.S. Pat. No. 3,887,863.) In some instances, it may be desirable to connect a ten picofarad capacitor between conductors 21 and 27 to further ensure stable circuit operation, especially if unusual load conditions are present.

Figure 2:
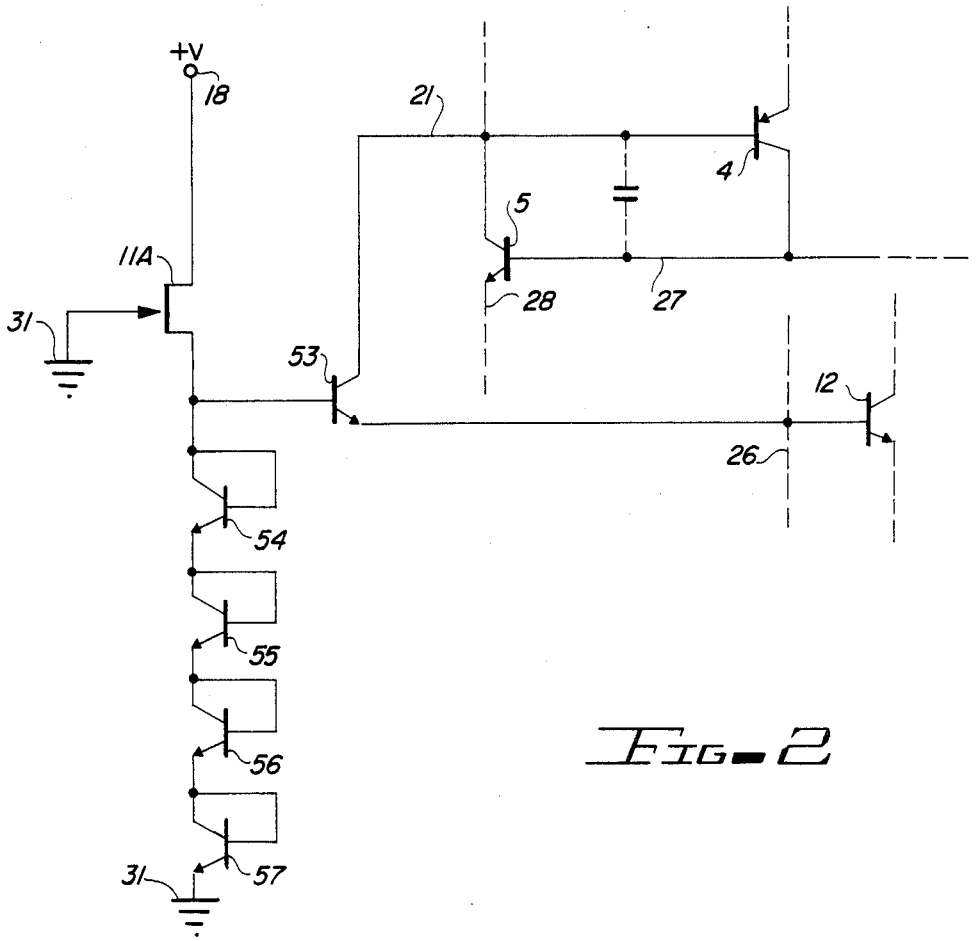
FIG. 2 is a circuit diagram illustrating an alternate starting circuit that can be used in conjunction with the circuit of FIG. 1.

Referring now to FIG. 2, an alterate starting circuit to that shown in FIG. 1 is illustrated. Instead of using junction field effect transistor 11, as shown in FIG. 1, an analogous junction field effect transistor 11A, has its gate electrode connected to ground conductor 31, has its drain electrode connected to positive supply voltage conductor 18, and its source electrode connected to the base of NPN transistor 53. The source electrode of junction field effect transistor 11A is also connected to a series string of four diode-connected transistors 54, 55, 56, and 57, the "cathode" of diode-connected transistor 57 being connected to ground conductor 31.

The collector of NPN transistor 53 is connected to conductor 21 of FIG. 1 (assuming junction field effect transistor 11 is removed). When the positive supply voltage +V increases, and NPN transistor 53 is turned on, the collector current thereof drawn from the base of PNP transistor 4 actuates the current mirror circuit including PNP transistors 1 and 3, as previously explained.

To give a further boost to the start-up operation, the resulting current flowing through NPN transistor 53 also flows into the base of NPN transistor 12, thereby simultaneously establishing the input offset voltage across resistor 41 and actuating NPN current mirror transistors 15 and 16.

Figure 3:
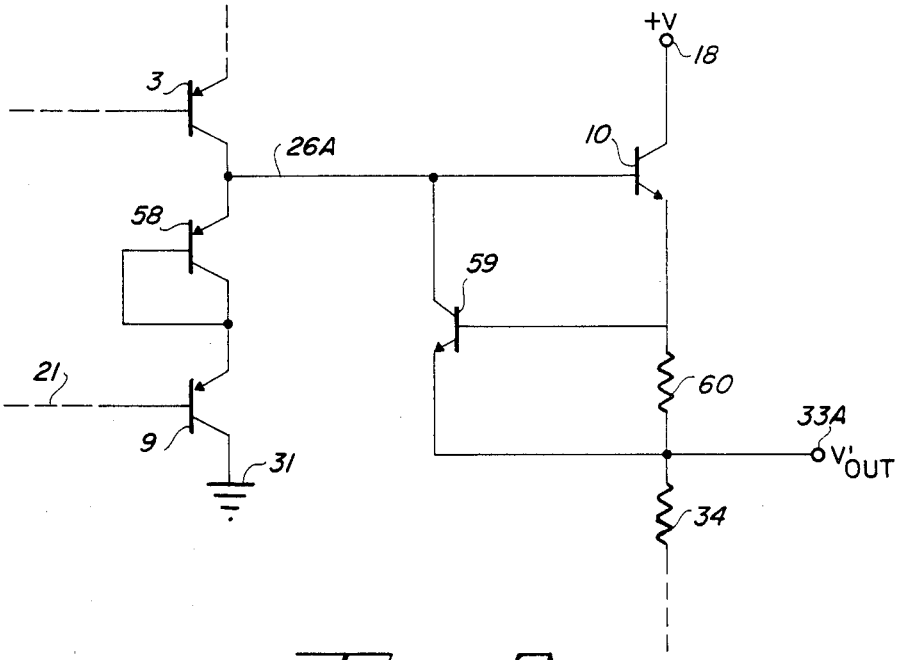
FIG. 3 is a circuit schematic diagram of an altered output circuit that can be used in conjunction with the band gap voltage reference circuit of FIG. 1.

Referring next to FIG. 3, a useful alternative output circuit to the one of FIG. 1 is shown. Here, the voltage at the emitter of PNP transistor 9 is shifted up by one diode drop, by means of diode connected NPN transistor 58. The resulting upwardly shifted voltage level on conductor 26A is applied to the base of NPN emitter follower output transistor 10. In this case, an NPN transistor 59 has its collector connected to the base of NPN transistor 10, has its base connected to the emitter of NPN transistor 10, and has its emitter connected to conductor 33A, which is analogous to conductor 33 in FIG. 1. This output, in conjunction with a user-supplied external transistor which produces a voltage $V_{OUT}'$ analogous to $V_{OUT}$ in FIG. 1, has a very high current driving capability. A resistor 60 is connected between the base and emitter of NPN transistor 59.

While the invention has been described with reference to a particular embodiment thereof, those skilled in the art will be able to make various modifications to the described embodiment without departing from the true spirit and scope of the invention.

We claim:

1. An improved band gap voltage reference circuit comprising in combination:

(a) a band gap cell including first and second NPN transistors and first and second PNP transistors, the emitters of said first and second NPN transistors being connected together, the emitters of said first and second PNP transistors being connected together, the collectors of said first PNP transistor and said first NPN transistor being connected together, the collector and base of said second PNP transistor being connected to the base of said first PNP transistor and to the collector of said second NPN transistor;

(b) a first resistor coupled between the bases of said first and second NPN transistors, and a second resistor connected to the base of said second NPN transistor;

(c) first constant current source means responsive to a first control current flowing through said first and second resistors for causing a first constant current to flow out of the junction between the emitters of said first and second NPN transistors, said first constant current source means also producing a second constant current substantially greater than said first constant current, said first constant current causing said first and second NPN transistors to produce a differential offset voltage across said first resistor to produce said first control current;

(d) a third NPN transistor having its emitter connected to supply said first control current to said first resistor;

(e) a third PNP transistor having its emitter coupled to the emitters of said first and second PNP transistors and having its base coupled to the collector of said first NPN transistor and having its collector connected to supply some of said second constant current;

(f) second constant current source means responsive to a second control current determined by said second constant current and the current flowing through said third PNP transistor for producing a third constant current, a portion of which flows through said third NPN transistor, and for producing a fourth constant current;

(g) a fourth PNP transistor having its base coupled to the emitters of said first, second, and third PNP transistors and its emitter connected to receive some of said third constant current, (h) a fourth NPN transistor having its base coupled to the emitter of said fourth PNP transistor and its emitter coupled to the base of said third NPN transistor;

(i) a third resistor coupled to the base of said third NPN transistor, said fourth PNP transistor, said fourth NPN transistor, said second resistor, and said third NPN transistor providing high gain feedback from said band gap cell to produce said first control current in said first resistor to thereby apply said differential offset voltage between the bases of said first and second NPN transistors; and (j) a fifth NPN transistor having its emitter coupled to the collector of said third PNP transistor and its base coupled to the emitter of said third PNP transistor, in order to effectively bootstrap the collector voltage of said third PNP transistor to the emitter of said third PNP transistor.

2. The improved band gap voltage reference circuit of claim 1 including a fourth resistor coupling the emitter of said fourth NPN transistor to the base of said third NPN transistor.

3. The improved band gap voltage reference circuit of claim 2 wherein the ratio of the resistances of said first and second resistors has a value that causes the voltage of the base of said third NPN transistor to be substantially independent of temperature.

4. The improved band gap voltage reference circuit of claim 3 wherein the ratio of the resistances of said third and fourth resistors has a value that causes the voltage of the emitter of said fourth NPN transistor to have a value that is a predetermined scaled-up value of the voltage on the base of said third NPN transistor.

5. The improved band gap voltage reference circuit of claim 4 wherein said third constant current is substantially greater than said first control current, said second control current is substantially less than said second constant current, and said fourth constant current is substantially greater than said first constant current.

6. The improved band gap voltage reference circuit of claim 5 including a fifth PNP transistor connected to control flow of said fourth constant current into said band gap cell and said third PNP transistor.

7. The improved band gap voltage reference circuit of claim 6 including starting circuit means responsive to a supply voltage applied to said improved band gap voltage reference circuit for causing said second control current to initially flow.

8. The improved band gap voltage reference circuit of claim 6 including starting circuit means responsive to a supply voltage applied to said improved band gap voltage reference circuit for causing said first control current to initially flow.

9. The improved band gap voltage reference circuit of claim 1 wherein the ratio of the emitter areas of said first and second NPN transistors is a predetermined value N in order to make said differential offset voltage approximately equal to $kT/q\ln(N)$.

10. The improved band gap voltage reference circuit of claim 1 including capacitive means coupled to the collector of said first NPN transistor to stabilize the voltage thereof.

11. An improved band gap voltage reference circuit comprising in combination:

(a) band gap circuit means, having a pair of differential input terminals for receiving a differential input offset voltage therebetween in order to allow a first constant current to flow through said band gap cell, for producing an incremental output signal in response to an incremental variation in said differential input offset voltage applied between said differential input terminals;

(b) double bootstrapping means responsive to said incremental output signal for maintaining the output impedance encountered by said incremental output signal at a very high value by bootstrapping said incremental output signal to another conductor to which said output impedance is connected in order to cause said output impedance to have said very high value;

(c) first resistive means located outside of said band gap cell and coupled between said differential input terminals for conducting a feedback current which develops said differential input offset voltage;

(d) buffer circuit means responsive to said bootstraping means for supplying said feedback current to said first resistive means;

(e) second resistive means located outside of said band gap cell and coupled to said first resistive means for conducting substantially all of said feedback current to effectuate setting of the temperature coefficient of a reference voltage produced at a junction between said first and second resistive means to a predetermined value; and (f) third and fourth resistive means coupled to said buffer circuit means and said first resistive means for scaling up said reference voltage.

12. The improved band gap reference voltage circuit of claim 11 wherein said buffer circuit means includes a first emitter follower coupled to drive a second emitter follower and a feedback transistor, the emitter of said feedback transistor being coupled to said first resistive means, the collector of said feedback transistor being coupled to an output of said first emitter follower, and the base of said feedback transistor being coupled by said second resistive means to an output of said second emitter follower.

13. A method of producing a band gap reference voltage, said method comprising the steps of:

(a) causing a first constant current to flow through a band gap cell having a pair of differential input terminals and causing a differential offset voltage to be produced across a first resistor coupled between said differential input terminals;

(b) operating said band gap cell to sense and amplify an incremental error change in the differential offset voltage applied between said pair of differential input terminals and thereby produce a first incremental current signal;

(c) causing said first incremental current signal to flow through a load impedance circuit, said flowing of said first incremental current signal through said load impedance circuit causing an incremental voltage signal to be produced at an output of said band gap cell;

(d) bootstrapping said incremental voltage signal to another conductor to which said load impedance circuit is connected, thereby causing said load impedance circuit to have a very high impedance and thereby causing the product of that impedance and the transconductance of said band gap cell to be very large, and thereby causing the gain of said band gap cell to be very large;

(e) coupling said incremental voltage signal to an input of a first voltage follower circuit;

(f) applying the output voltage of said first voltage follower circuit to said first resistor to thereby produce said differential offset voltage across said first resistor;

(g) causing the current flowing through said first resistor to also flow through a second resistor connected in series with said first resistor to produce said band gap voltage and causing the resistances of said first and second resistors to have a ratio such that the temperature coefficient of said band gap voltage has a predetermined value; and (h) resistively scaling up the value of said band gap voltage to a predetermined level by applying said band gap voltage across a third resistor and causing the resulting current flowing through said resistor to also flow through a fourth resistor.

14. The method of claim 13 wherein step (g) includes causing said current flowing through said second resistor to also flow through the emitter-base junction of a transistor having its emitter connected to said second resistor, the voltage on the base of said transistor being said band gap voltage.

15. The method of claim 11 wherein said band gap cell includes first and second emitter-coupled NPN transistors, the bases of which are connected to said differential input terminals, respectively, and first and second emitter-coupled PNP transistors, the bases of which are also connected together, the collectors of said first PNP transistor and said first NPN transistor being connected together, the base and collector of said second PNP transistor being connected to the collector of said second NPN transistor.

16. A circuit for producing a band gap reference voltage, said circuit comprising:

(a) a first resistor;

(b) a band gap cell having a pair of differential input terminals and means therein for causing a differential offset voltage to be produced across said first resistor in response to a first constant current flowing through said band gap cells, said first resistor being coupled between said differential input terminals;

(c) means for causing said first constant current to flow through said band gap cell;

(d) load impedance means coupled to cause said band gap cell to sense and amplify an incremental error change in the differential offset voltage applied between said pair of differential input terminals, said band gap cell producing a first incremental current signal in response to said incremental error change;

(e) means for causing said first incremental current signal to flow through said load impedance means to produce an incremental voltage signal at an output of said band gap cell;

(f) means for bootstrapping said incremental voltage signal to another conductor to which said load impedance means is connected, thereby causing said load impedance circuit to have a very high impedance and thereby causing the product of that impedance and the transconductance of said band gap cell to be very large, and thereby causing the gain of said band gap cell to be very large;

(g) a first voltage follower circuit;

(h) means for coupling said incremental voltage signal to an input of said first voltage follower circuit; and (i) means for applying the output voltage of said first voltage follower circuit to said first resistor to thereby produce said differential offset voltage across said first resistor.

* * * * *